US006935297B2

(12) United States Patent
Honda et al.

(10) Patent No.: US 6,935,297 B2
(45) Date of Patent: Aug. 30, 2005

(54) LUBRICATING SYSTEM FOR 4-CYCLE ENGINE

(75) Inventors: Sohei Honda, Saitama (JP); Yoshikazu Sato, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 11 days.

(21) Appl. No.: 10/624,084

(22) Filed: Jul. 21, 2003

(65) Prior Publication Data

US 2004/0094113 A1 May 20, 2004

(30) Foreign Application Priority Data

Jul. 24, 2002 (JP) ..... 2002-215627
Jul. 24, 2002 (JP) ..... 2002-215628

(51) Int. Cl.[7] ..... F01M 1/00
(52) U.S. Cl. ..... 123/196 R
(58) Field of Search ..... 123/196 R, 184.57, 123/196 M, 90.33

(56) References Cited

U.S. PATENT DOCUMENTS 5,860,403 A * 1/1999 Hirano et al. ..... 123/196 R
6,152,098 A 11/2000 Becker et al.
6,510,829 B2 * 1/2003 Ito et al. ..... 123/196 R
6,666,184 B2 * 12/2003 Kurihara et al. ..... 123/196 R

FOREIGN PATENT DOCUMENTS

EP 0 962 630 A 12/1999
EP 1 092 844 A 4/2001
EP 1 149 997 A 10/2001
EP 1 152 130 A 11/2001
JP 2002038916 2/2002

* cited by examiner

*Primary Examiner*—Willis R. Wolfe
*Assistant Examiner*—Katrina Harris
(74) *Attorney, Agent, or Firm*—Carrier, Blackman & Associates, P.C.; Joseph P. Carrier; William D. Blackman

(57) ABSTRACT

A lubricating system for a 4-cycle engine reduces overall engine size and number of parts, and simplifies engine structure. The engine includes a side cover bonded to the crankcase defining a first valve-operating chamber, and a head cover bonded to the cylinder block defining a second valve-operating chamber. Oil reservoir chambers are formed in the crankcase and the side cover. Oil supply passages are provided in the crankshaft to permit a portion of each oil reservoir chamber below an oil surface therein to communicate with the crank chamber so that the oil passed through the oil supply passages is scattered by rotation of the crankshaft to produce an oil mist. The crank chamber communicates with the first valve-operating chamber through a one-way valve. A recovery bore opens into the second valve-operating chamber for recovering oil and communicates with each of the oil reservoir chambers above the oil surface.

6 Claims, 12 Drawing Sheets

LUBRICATING SYSTEM FOR 4-CYCLE ENGINE

BACKGROUND OF THE INVENTION

1. Field of the Invention

The present invention relates to an improvement in a lubricating system for a 4-cycle engine in which a side cover defining a first valve-operating chamber is bonded to one side of a crankcase defining a crank chamber which accommodates a crank portion of a crankshaft; a head cover defining a second valve-operating chamber leading to the first valve-operating chamber is bonded to a head portion of a cylinder block connected to the crankcase; and a valve-operating mechanism is accommodated in a region extending from the first valve-operating chamber to the second valve-operating chamber, and particularly to a dry-sump-type lubricating system of the above structure in which a lubricating oil is prevented from residing in the crank chamber.

2. Description of the Related Art

There is a conventional lubricating system of a dry sump type, in which an oil tank is mounted on one side of a crankcase, and an oil slinger driven to rotate by a crankshaft is disposed in the oil tank, so that an oil mist produced by stirring an oil stored in the oil tank is supplied to a crank chamber and a valve-operating chamber, as disclosed, for example, in Japanese Patent Application Laid-open No. 2002-38916.

In the above-described lubricating system including the oil tank disposed on one side of the crankcase, it is difficult to compactly form the entire engine including the oil tank. In addition, the disposition of the oil slinger for producing the oil mist results in an increase in the number of parts and complication of the structure. Moreover, the shape of the oil tank is limited to a cylindrical shape by the oil slinger, thereby making it further difficult to compactly form the entire engine.

SUMMARY OF THE INVENTION

Accordingly, it is an object of the present invention to provide a lubricating system for a 4-cycle engine, wherein the size of the entire engine can be reduced, while decreasing the number of parts and simplifying the structure.

To achieve the above object, according to a first feature of the present invention, there is provided a lubricating system for a 4-cycle engine in which a side cover defining a first valve-operating chamber is bonded to one side of a crankcase defining a crank chamber which accommodates a crank portion of a crankshaft; a head cover defining a second valve-operating chamber leading to the first valve-operating chamber is bonded to a head portion of a cylinder block connected to the crankcase; and a valve-operating mechanism is accommodated in a region extending from the first valve-operating chamber to the second valve-operating chamber, wherein oil reservoir chambers for storing a lubricating oil up to a level higher than a journal portion of the crankshaft are formed in the crankcase and the side cover to surround the crank chamber and the first valve-operating chamber; oil supply passages are provided in the crankshaft to permit a portion of each of the oil reservoir chambers below an oil surface therein to communicate with the crank chamber so that the oil passed through the oil supply passages can be scattered to produce an oil mist; the crank chamber is put into communication with the first valve-operating chamber through a one-way valve which is adapted to be opened only when the pressure in the crank chamber is raised; a recovery bore which opens into a bottom of the first valve-operating chamber or the second valve-operating chamber for recovering liquefied oil is put into communication with a portion of each of the oil reservoir chambers above the oil surface; and a breather chamber is put into communication with an upper portion of the second valve-operating chamber.

The oil reservoir chambers correspond to first and second oil reservoir chambers in embodiments of the present invention which will be described hereinafter. The oil supply passages correspond to an oil bore 35 provided in the crankshaft 5; a delivery dish 37, a hollow 36 and an oil supply bore 38. The one-way valve corresponds to a reed valve 42.

With the first feature, the oil reservoir chambers can be formed only by slightly enlarging the crankcase and the side cover in radial directions. Moreover, an oil slinger for producing an oil mist is not required by the arrangement in which the oil drawn from the oil reservoir chambers into the oil supply bores is scattered to produce the oil mist. Thus, it is possible to achieve a simplification of the structure by a reduction in the number of parts, and further the degree of freedom of the shape of each oil reservoir chambers is increased because they have no oil slingers, thereby effectively achieving a compactness of the entire engine.

According to a second feature of the present invention, in addition to the first feature, a check valve adapted to be opened upon a reduction in pressure in the crank chamber is incorporated in at least one of the oil supply passages.

With the second feature, when the engine is in an operation-stopped state, the oil supply passages in the crankshaft are shut off by closing the check valve. Therefore, even when the engine E is disposed in any inclined attitude, for example, during installation of the engine E, the oil can be prevented from flowing unreasonably into the crank chamber.

According to a third feature of the present invention, in addition to the first feature, the oil supply passages in the crankshaft are put into communication with a portion of each of the oil reservoir chambers below the oil surface through a bent communication passage having an intermediate portion disposed in a bent shape above the oil surface of each of the oil reservoir chambers.

The bent communication passages correspond to oil passages 61 to 64 in the second embodiment of the present invention which will be described hereinafter.

With the third feature, the oil can be prevented from disadvantageously flowing from the oil reservoir chambers into the crank chamber in any inclined attitude of the engine during stoppage of the operation of the engine by the extremely simple structure in which the bent communication passage having an intermediate portion is disposed in the bent shape above the oil surface of each of the oil reservoir chambers.

According to a fourth feature of the present invention, in addition to the first feature, a first oil reservoir chamber is formed in the crankcase to surround the crank chamber, and a second oil reservoir chamber is formed between the crankcase and the side cover bonded to one side of the crankcase to define the valve-operating chamber which accommodates the valve-operating mechanism; the first and second oil reservoir chambers being in communication with each other.

A total volume of the first and second oil reservoir chambers communicating with each other is large, so that a large amount of oil can be stored therein, and hence the operation of the engine for a long period is possible. Moreover, the first and second oil reservoir chambers can be formed only by slightly enlarging the crankcase and the side cover in radial directions to contribute to the compactness of the engine.

According to a fifth feature of the present invention, in addition to the fourth feature, the crankcase is comprised of first and second case halves bonded at their bonded surfaces perpendicular to an axis of the crankshaft; the first oil reservoir chamber is formed by recesses formed in the bonded surfaces of the first and second case halves to surround the crank chamber; the second oil reservoir chamber is formed by recesses formed in bonded surfaces of the second case half and the side cover bonded to an outer side of the second case half to surround the valve-operating chamber; and a through-bore permitting the communication between the first and second oil reservoir chambers is provided in the second case half.

With the fifth feature, when the first and second case halves and the side cover are formed by casting, they can be formed simultaneously with the formation of the crank chamber and the first valve-operating chamber, leading to an easy manufacture and a reduction in cost.

The above and other objects, features and advantages of the invention will become apparent from the following description of the preferred embodiments taken in conjunction with the accompanying drawings.

DESCRIPTION OF THE PREFERRED EMBODIMENTS

The present invention will now be described by way of preferred embodiments with reference to the accompanying drawings.

A first embodiment of the present invention shown in FIGS. 1 to 7 will be described.

Figure 1:
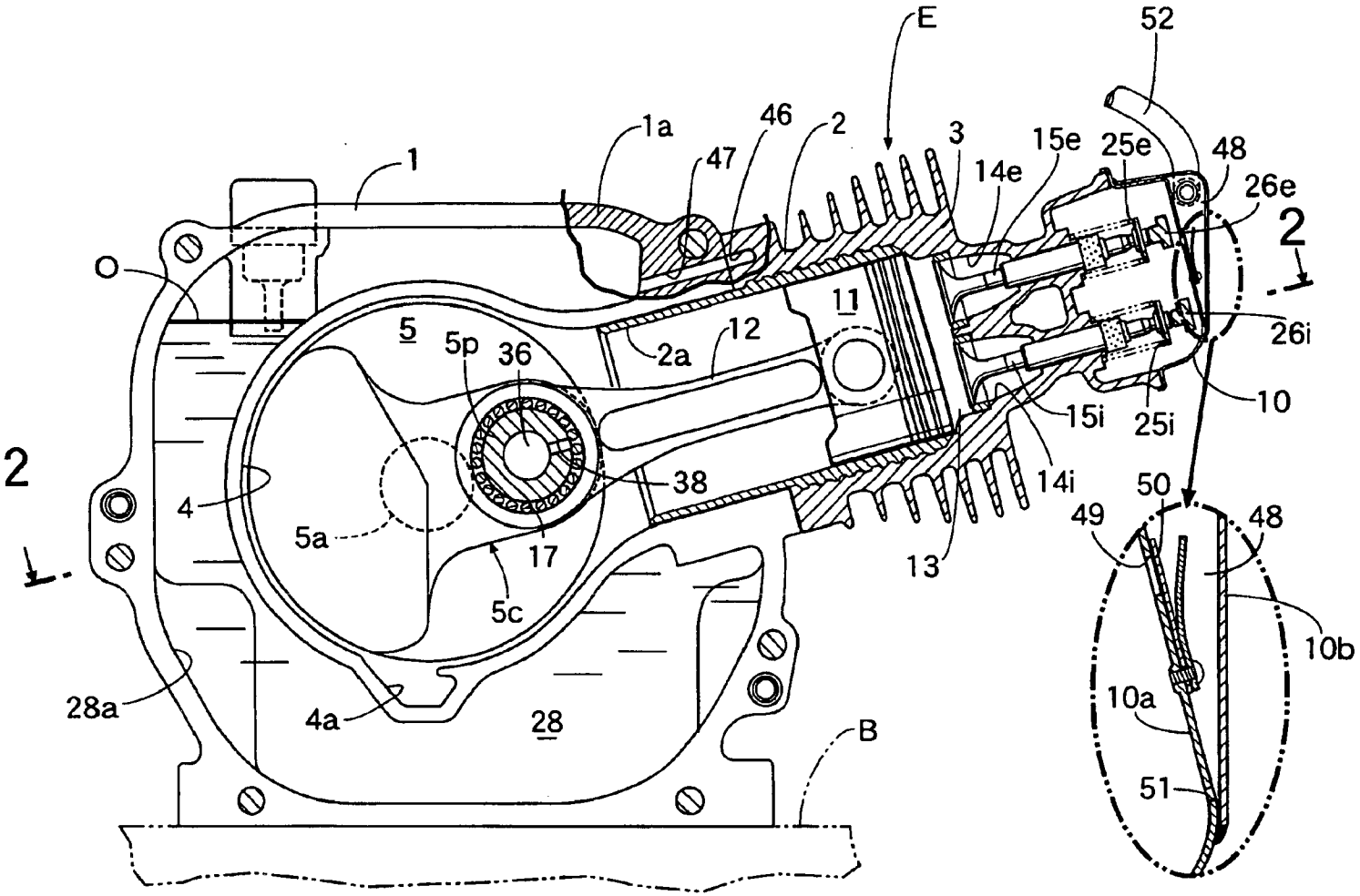
FIG. 1 is a vertical sectional plan view of a 4-cycle engine for a power working machine according to a first embodiment of the present invention.
Figure 2:
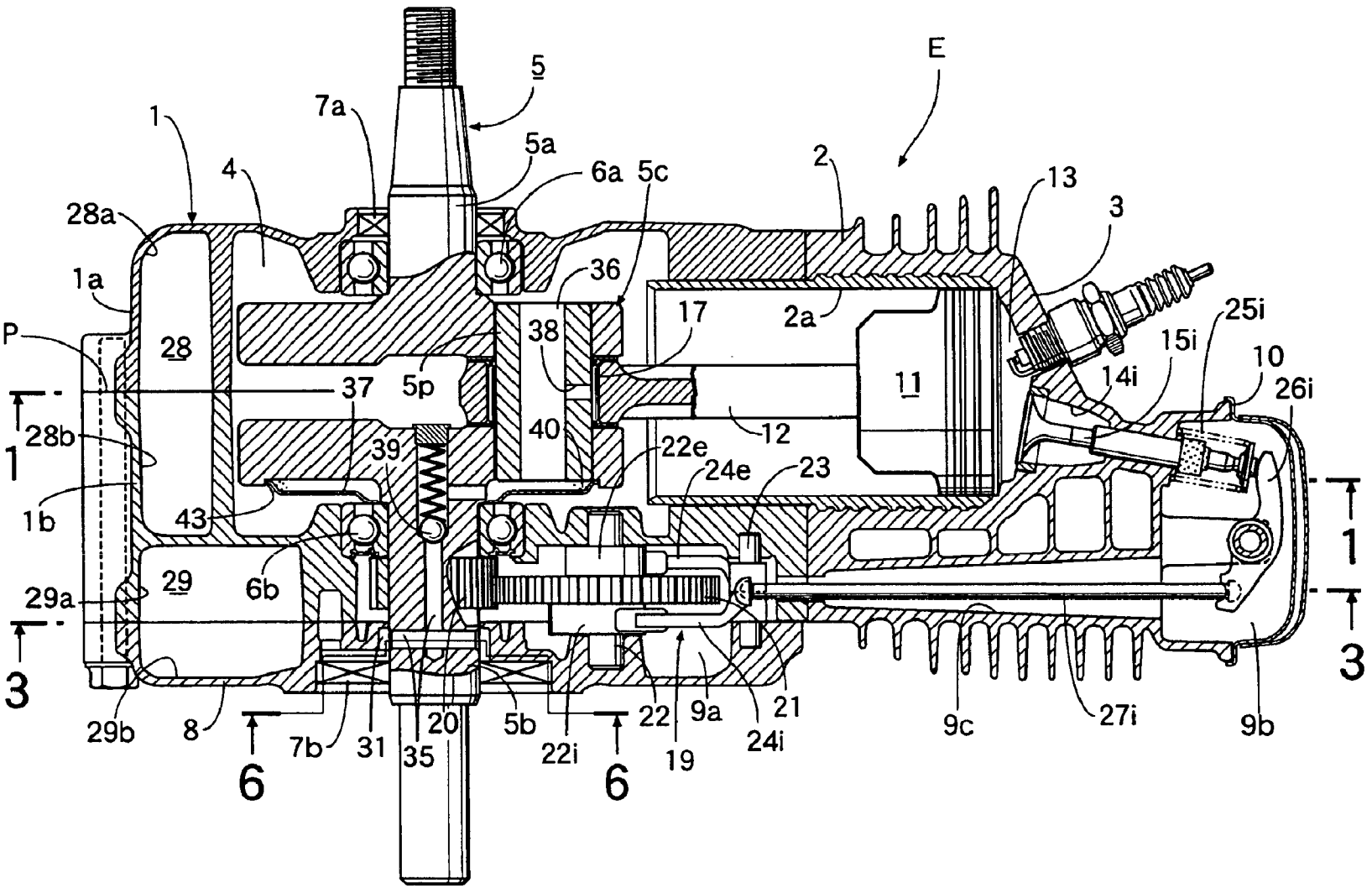
FIG. 2 is a sectional view taken along a line 2—2 in FIG. 1.
Figure 3:
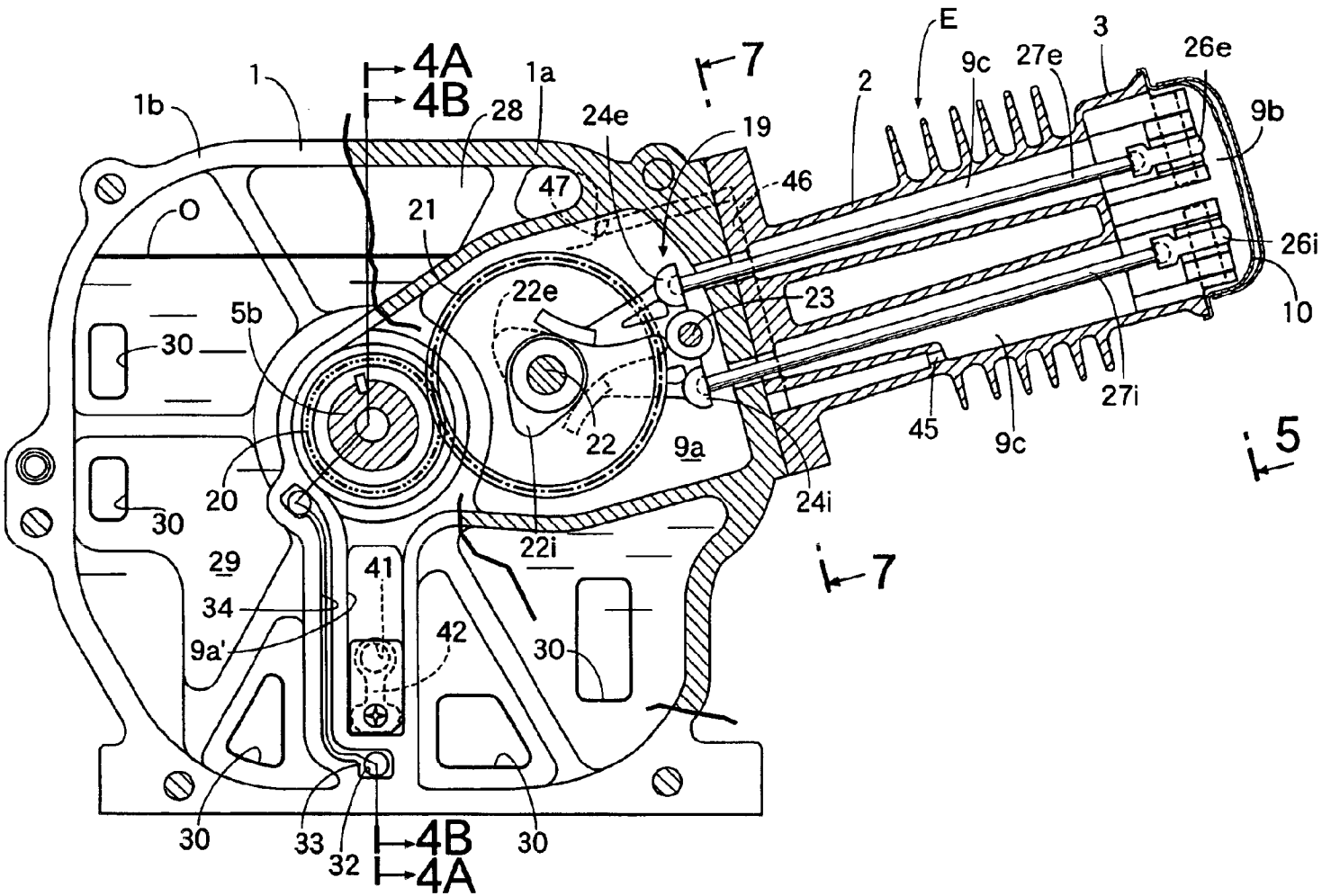
FIG. 3 is a sectional view taken along a line 3—3 in FIG. 2.

Referring first to FIGS. 1 to 3, a 4-cycle engine E mounted on an engine bed B of a power working machine comprises an engine body including a crankcase 1 and a cylinder block 2 coupled in a forward inclined attitude to a front end of the crankcase 1. A cylinder head 3 is integrally formed at a head of the cylinder block 2.

The crankcase 1 comprises first and second, that is, left and right case halves 1*a* and 1*b* which are bonded to each other on a bonding plane P perpendicular to an axis of a crankshaft 5 which will be described hereinafter, thereby defining a crank chamber 4 therebetween. A crank portion 5*c* of the crankshaft 5 is accommodated in the crank chamber 4. First and second journal portions 5*a* and 5*b* at laterally opposite ends of the crankshaft 5 are supported by opposed sidewalls of the first and second case halves 1*a* and 1*b* with first and second ball bearings 6*a* and 6*b* interposed therebetween. An oil seal 7*a* is mounted on the sidewall of the first case half 1*a* adjacent the outer side of the first ball bearing 6*a*, to come into close contact with an outer peripheral surface of the first journal portion 5*a* of the crankshaft 5. The second ball bearing 6*b* is formed to have a seal.

A side cover 8 is bonded to an outer side of the second case half 1*b*. A first valve-operating chamber 9*a* is defined between the second case half 1*b* and the side cover 8. One end of the crankshaft 5 extends to the outside across the first valve-operating chamber 9*a* and through the side cover 8. An oil seal 7*b* is mounted on the side cover 8 to come into close contact with an outer peripheral surface of the one end.

A head cover 10 is bonded to the front end of the cylinder head 3 to define a second valve-operating chamber 9*b* between the head cover 10 and the cylinder head 3. A pair of rod passages 55, 55 are provided in the cylinder block 2 to provide communication between the first and second valve-operating chambers 9*a* and 9*b*.

A piston 11 slidably received in a cylinder bore 2*a* is connected to a crankpin 5*p* of the crank portion 5*c* through a connecting rod 12. In this process, a needle bearing 17 is interposed between the crankpin 5*p* and a larger end of the connecting rod 12.

An intake port 14*i* and an exhaust port 14*e* are formed in the cylinder head 3, and open into a combustion chamber 13 inside the cylinder head 3. An intake valve 15*i* and an exhaust valve 15*e* for opening and closing the ports 14*a* and 14*b* are mounted in the cylinder head 3. A valve-operating mechanism 19 for driving the intake and exhaust valves 15*i* and 15*e* to open and close the ports 14*a* and 14*b* is disposed in a region extending from the first valve-operating chamber 9*a* to the second valve-operating chamber 9*b*.

More specifically, disposed in the first valve-operating chamber 9*a* are a driving timing gear 20 formed on the crankshaft 5, a camshaft 22 rotatably supported at its opposite ends by the second case half 1*b* and the side cover 8, a driven timing gear 21 driven at a reduction ratio of 1/2 from the driving timing gear 20, a cam follower shaft 23 supported at its opposite ends by the first case half 1*a* and the side cover 8, and a pair of cam followers 24*i* and 24*e* swingably supported on the cam follower shaft 23 and slidably engaged with an intake cam 22*i* and an exhaust cam 22*e* on the camshaft 22. Disposed in the second valve-operating chamber 9*b* are valve springs 25*i* and 25*e* for biasing the intake valve 15*i* and the exhaust valve 15*e* in closing directions, respectively, and a pair of rocker arms 26*i* and 26*e* pivotally supported in the cylinder head 3 with one ends abutting against upper ends of the intake valve 15*i* and the exhaust valve 15*e*, respectively. A pair of pushrods 27*i* and 27*e* are disposed in the rod passages 55, 55 to connect the other ends of the rocker arms 26*i* and 26*e* and the cam followers 24*i* and 24*e* to each other, respectively.

Therefore, when the crankshaft 5 is rotated, the camshaft 22 is driven in a decelerated manner through the driving timing gear 20 and the driven timing gear 21. Thus, when the intake cam 22*i* and the exhaust cam 22*e* of the camshaft 22 push up the pushrods 27*i* and 27*e* through the cam followers 24*i* and 24*e*, respectively, the intake valve 15*i* and the exhaust valve 15*e* are opened. When the intake cam 22*i* and the exhaust cam 22*e* of the camshaft 22 permit the downward movements of the pushrods 27*i* and 27*e*, the intake valve 15*i* and the exhaust valve 15*e* are closed by biasing forces of the valve springs 25*i* and 25*e*.

Referring to FIGS. 1 to 4A, the crank chamber 4 in the crankcase 1 is formed into a cylindrical shape with a minimum volume in accordance with a rotational locus of the crankshaft 5, so that a lubricating oil is prevented from residing therein. Substantially U-shaped recesses 28*a* and 28*b* are formed respectively in bonded surfaces of the first and second case halves 1*a* and 1*b* to surround the crank chamber 4, thereby forming a first oil reservoir chamber 28. The recesses 28*a* and 28*b* are formed along with the crank chamber 4 upon the formation by casting of the first and second case halves 1*a* and 1*b*.

The first valve-operating chamber 9*a* is also formed between the second case half 1*b* and the side cover 8 at a necessary minimum volume, so that the lubricating oil is prevented from residing therein. Recesses 29*a* and 29*b* are formed in bonded surfaces of the second case half 1*b* and the side cover 8 to surround the first valve-operating chamber 9*a*, and a second oil reservoir chamber 29 is formed by the recesses 29*a* and 29*b*. The recesses 29*a* and 92*b* are formed along with the first valve-operating chamber 9*a* upon the formation of the second case half 1*b* and the side cover 8 by the casting process.

A plurality of through-bores 30 are provided in the second case half 1*b* in order to provide communication between the first and second oil reservoir chambers 28 and 29. The lubricating oil O is stored in each of the first and second oil reservoir chambers 28 and 29 up to a level higher than each of the first and second journal portions 5*a* and 5*b*.

As shown in FIGS. 2–4B and 6, an annular oil passage 31 is formed in the side cover 8 to surround the second journal portion 5*b* of the crankshaft 5 inside the oil seal 7*b*. The annular oil passage 31 communicates through a rising oil passage 34 with a small supply chamber 33 leading to a lower portion of the first oil reservoir chamber 28 through an outlet bore 32. The outlet bore 32 is provided in the second case half 1*b*. The small supply chamber 33 and the rising oil passage 34 are formed between the bonded surfaces of the second case half 1*b* and the side cover 8.

The crankshaft 5 is of an assembled type in which the opposite ends of the hollow crankpin 5*p* are press-fitted into crank arms having balance weights and integrally leading to the first and second journal portions 5*a* and 5*b*, thereby forming the crank portion 5*c*, and an oil bore 35 is provided in the second journal portion 5*b*. The oil bore 35 opens at one end into the annular oil passage 31 and at the other end into an inner end of an inner race of the second ball bearing 6*b*. A delivery dish 37 for delivering the oil from the oil bore 35 to a hollow 36 in the crankpin 5*p* is mounted at one end of the crank portion 5*c* having a balance weight. More specifically, the delivery dish 37 is deformed axially in a compressed manner to be set so that, upon the coupling of the first and second case half 1*a* and 1*b* to each other, its larger-diameter portion is fitted into a shallow annular positioning recess 43 formed in one end face of the crank portion 5*c*, and its smaller-diameter portion resiliently abuts against an inner end face of the inner race of the second ball bearing 6*c*. Thus, the delivery dish 37 can be mounted simply and precisely at one end of the crank portion 5*c* without use of a special securing member.

An oil supply bore 38 is provided in the crankpin 5*p* for supplying the oil from the hollow 36 to the needle bearing 17 between the crankpin 5*p* and the connecting rod 12. A check valve 39 is incorporated in the oil bore 35 for permitting the flow of a fluid in one direction from the annular oil passage 31 to the delivery dish 37.

An annular foreign matter reservoir 40 is provided in the delivery dish 37 and widen radially outwards from the hollow 36 in the crankpin 5*p*.

Figure 4A:
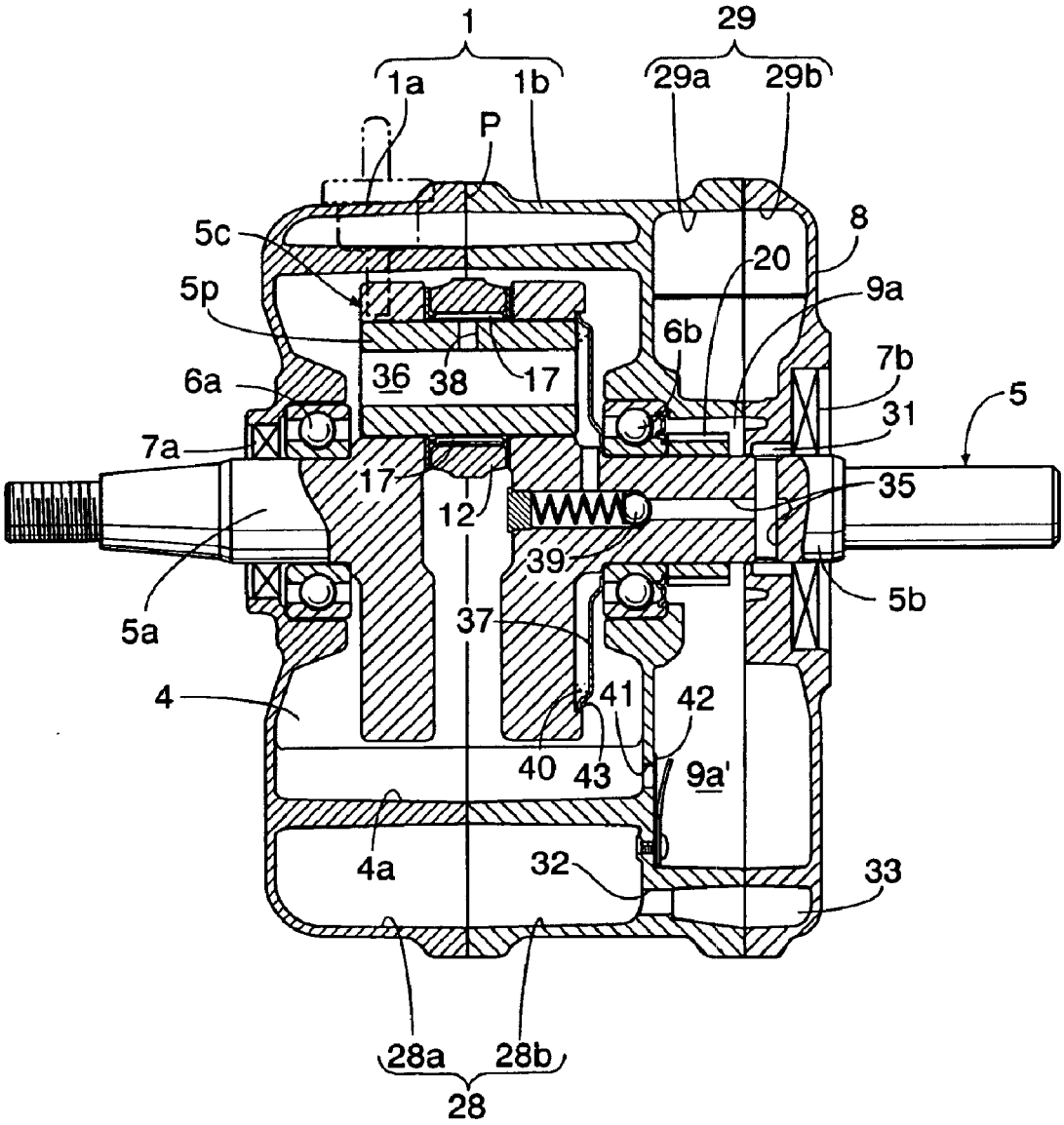
FIG. 4A is a sectional view taken along a line 4A—4A in FIG. 3.
Figure 4B:
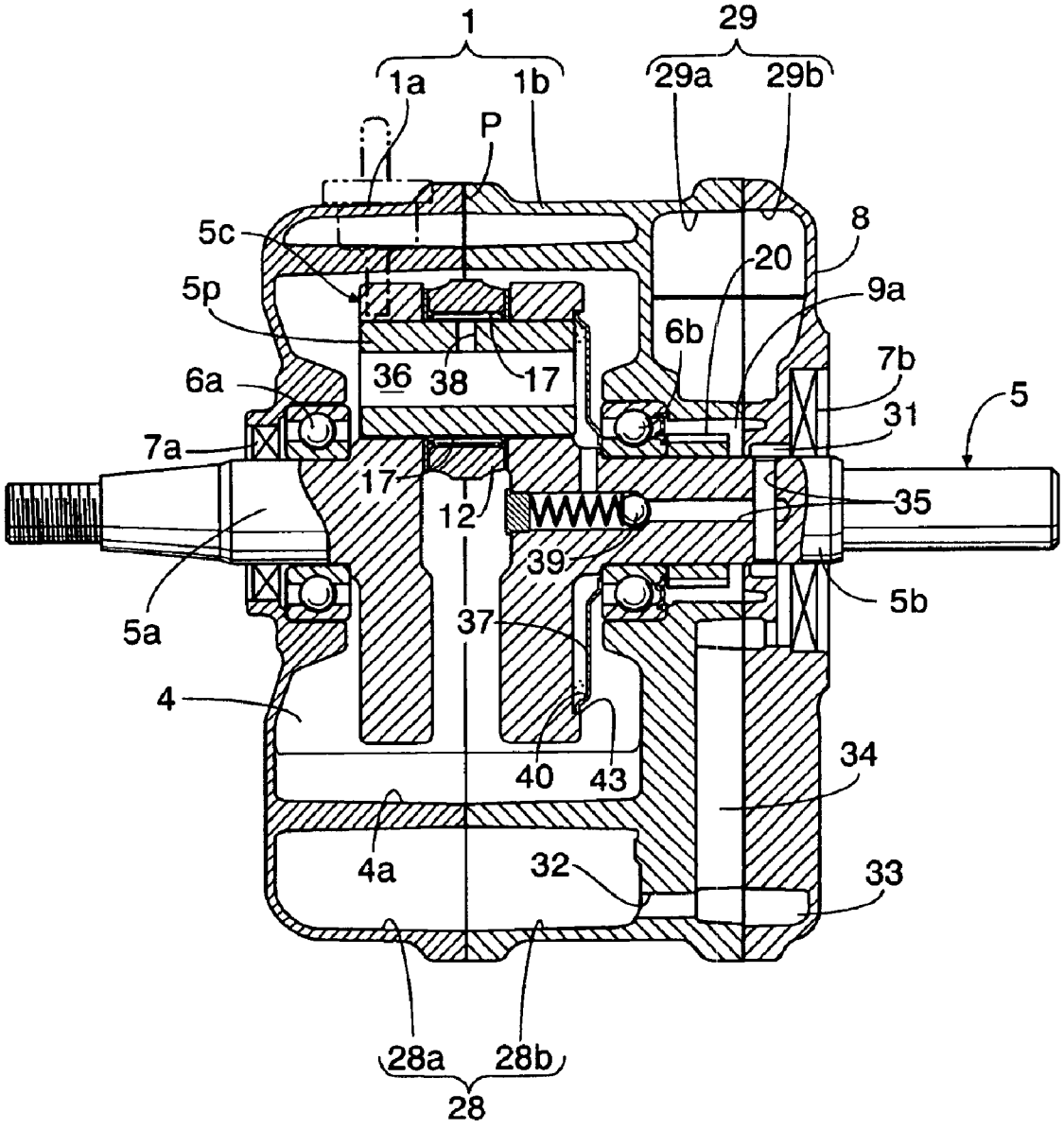
FIG. 4B is a sectional view taken along a line 4B—4B in FIG. 3.
Figure 5:
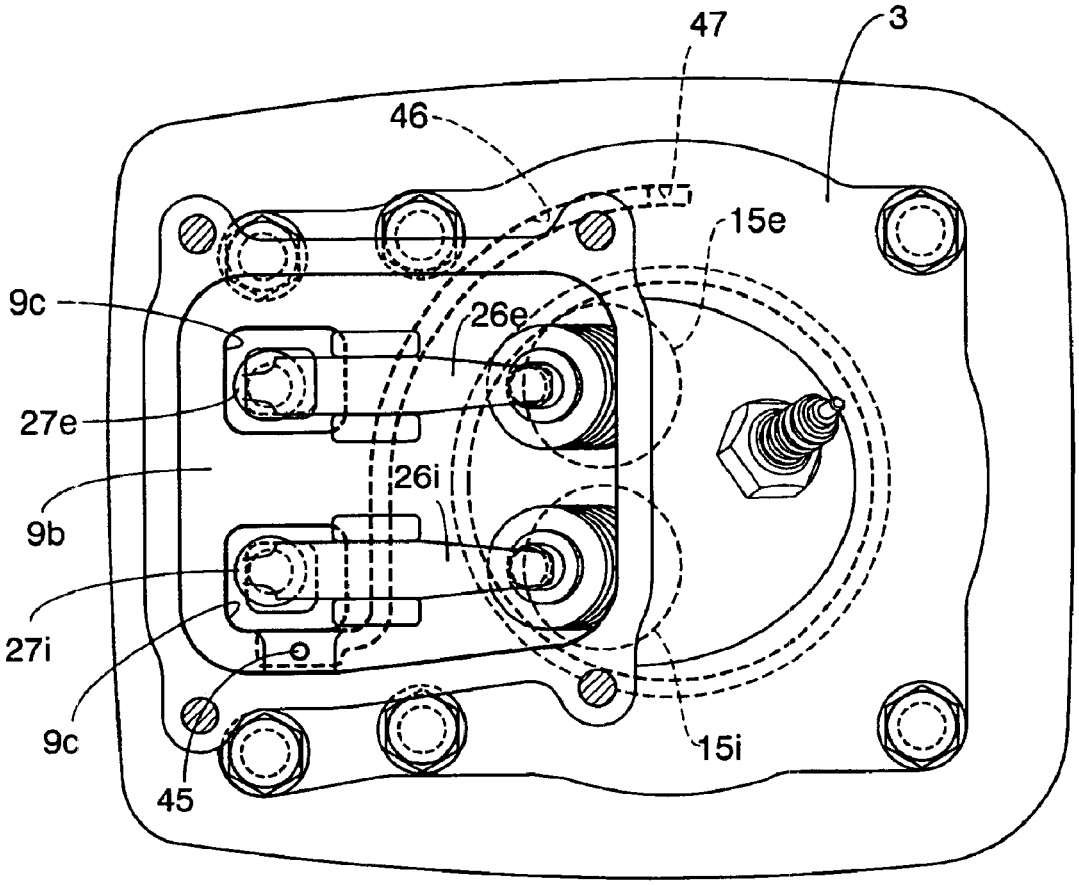
FIG. 5 is a sectional view taken along a line 5—5 in FIG. 3.
Figure 6:
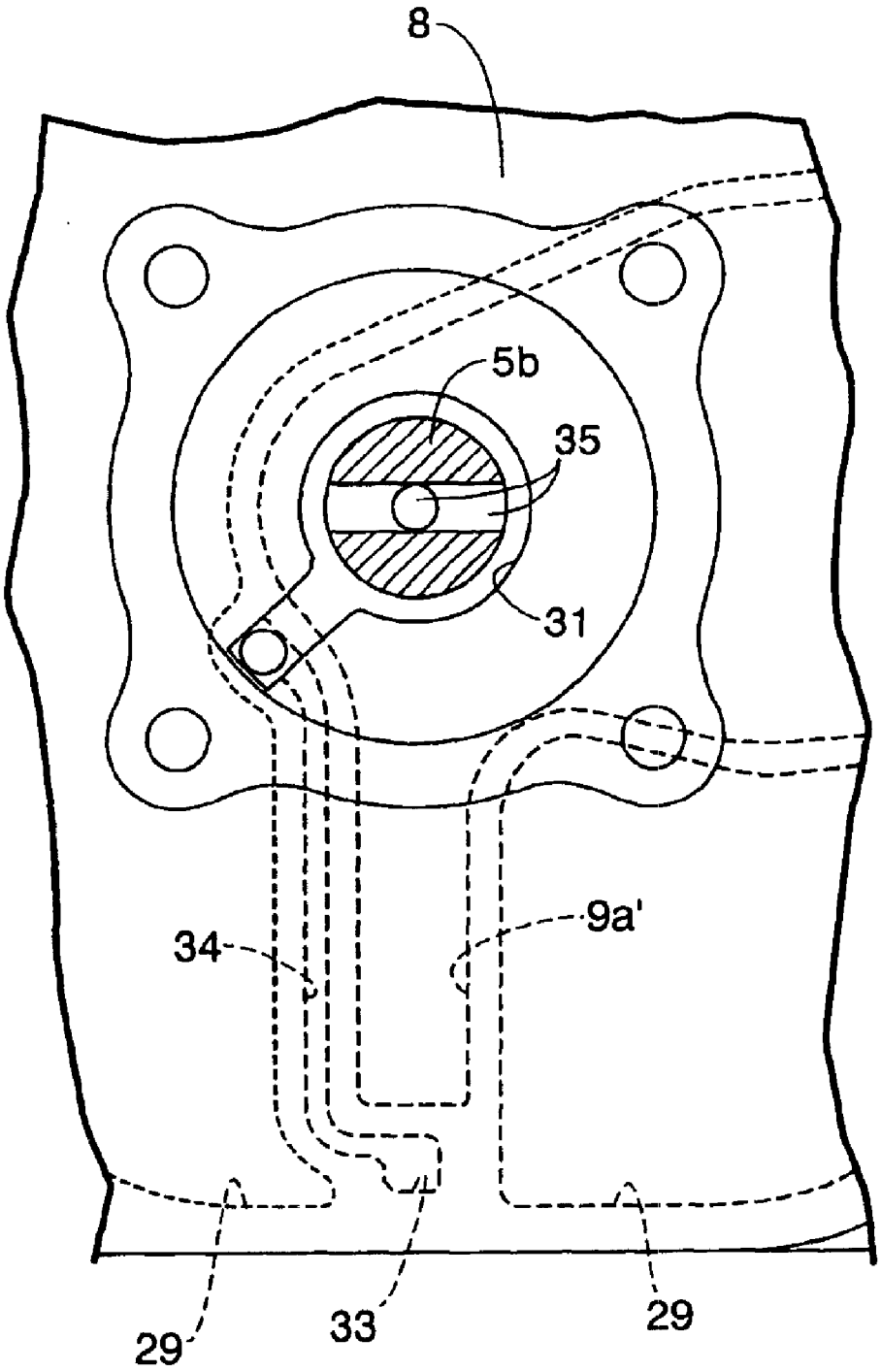
FIG. 6 is a sectional view taken along a line 6—6 in FIG. 2.

As shown in FIGS. 3 and 4A, a groove 4*a* is formed in a bottom of the crank chamber 4 to extend axially. A through-bore 41 is provided in the second case half 1*b* for permitting the groove 4*a* to communicate with an extension 9*a*' extending downwards from the first valve-operating chamber 9*a*. A reed valve 42 is mounted in the second case half 1*b* for permitting the flowing of the fluid in one direction from the crank chamber 4 to the first valve-operating chamber 9*a*.

Figure 7:
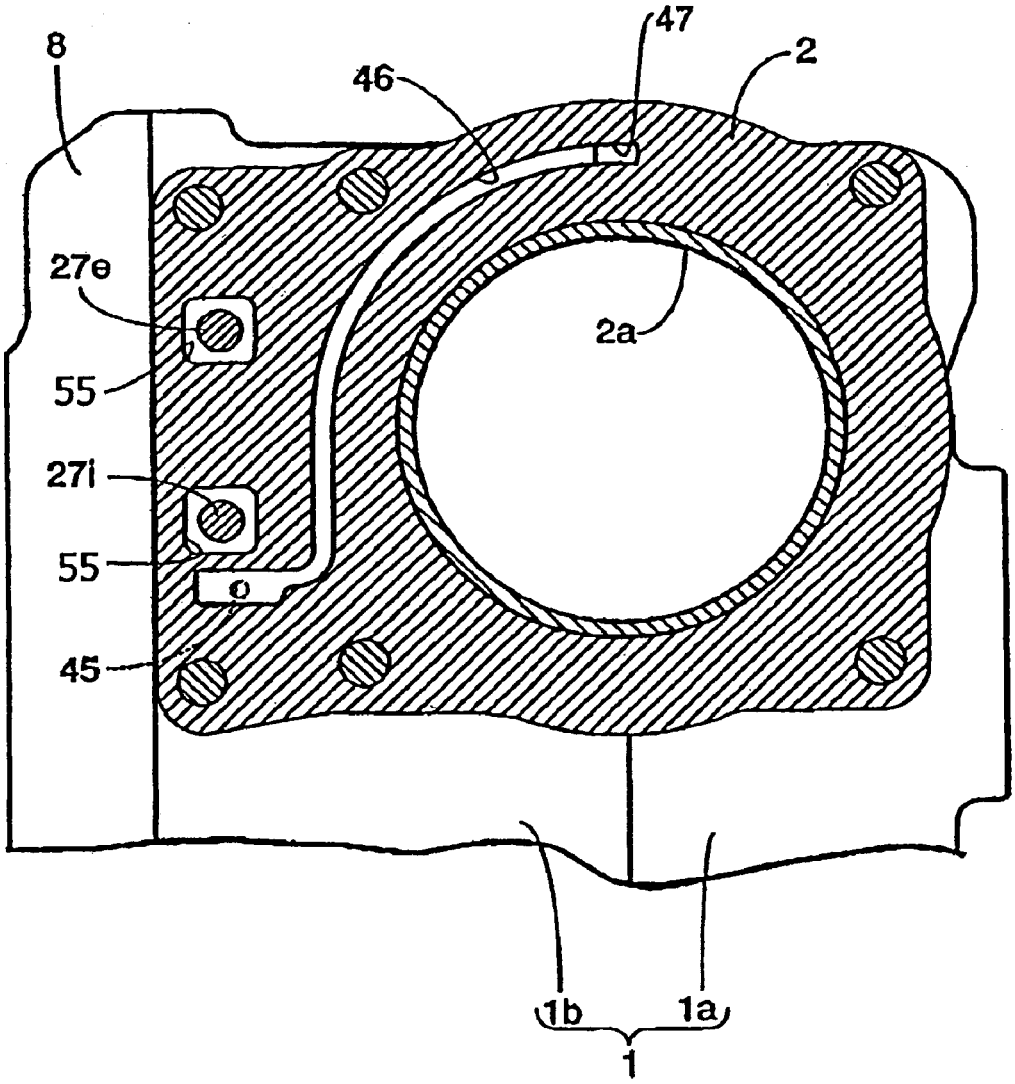
FIG. 7 is a sectional view taken along a line 7—7 in FIG. 3.
Figure 8:
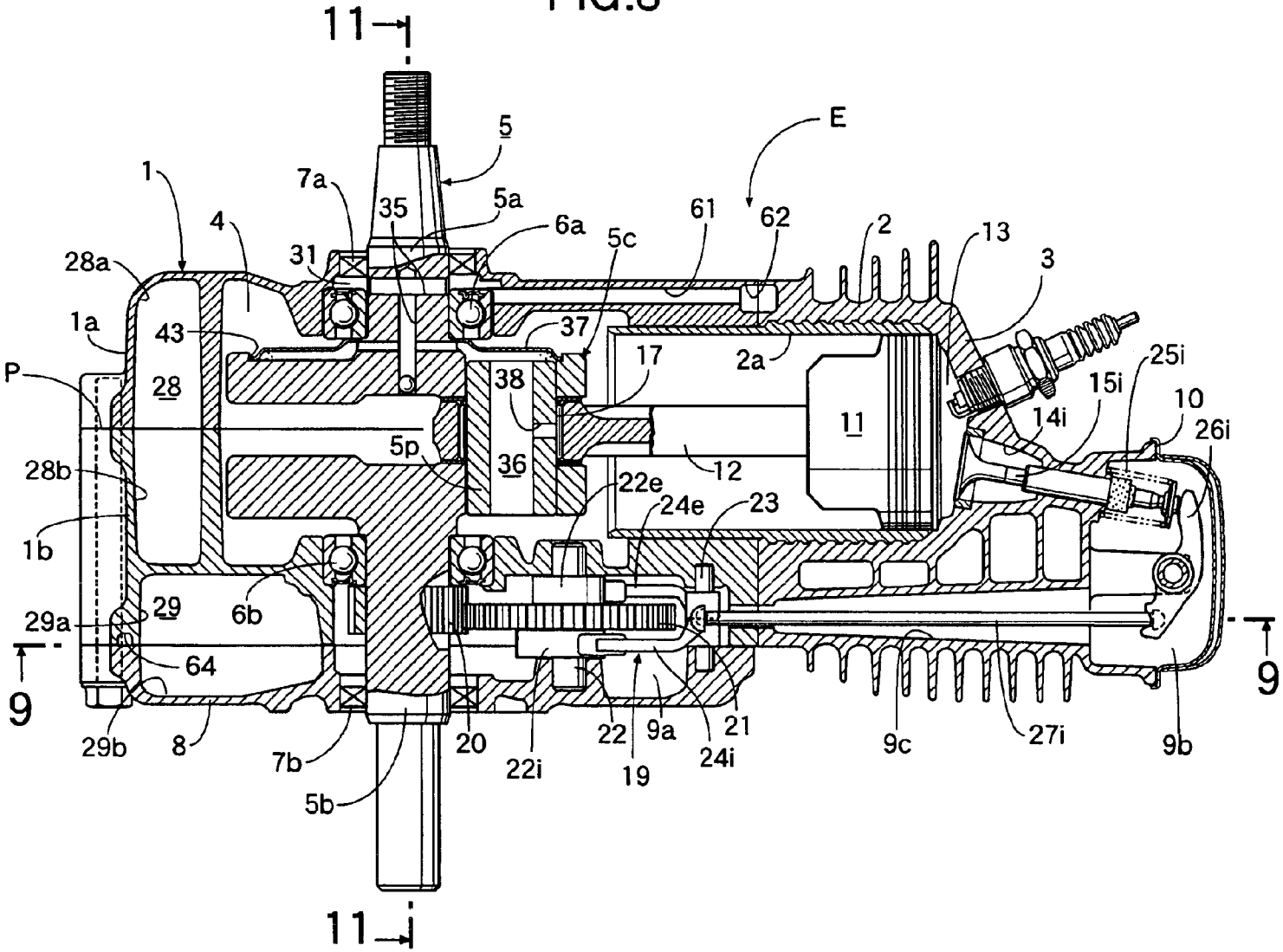
FIG. 8 is a view similar to FIG. 1, but showing a second embodiment of the present invention.
Figure 9:
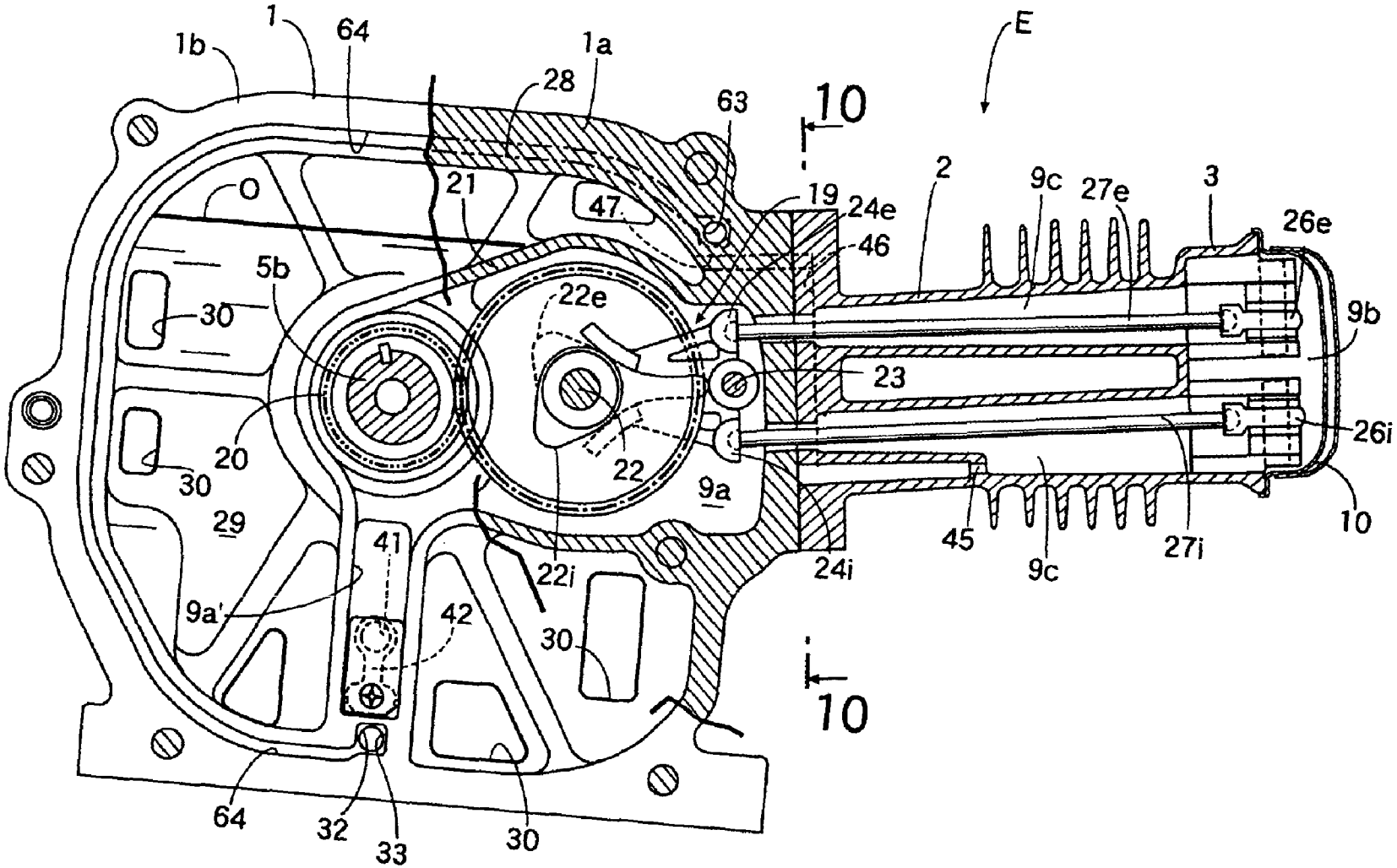
FIG. 9 is a sectional view taken along a line 9—9 in FIG. 8.
Figure 10:
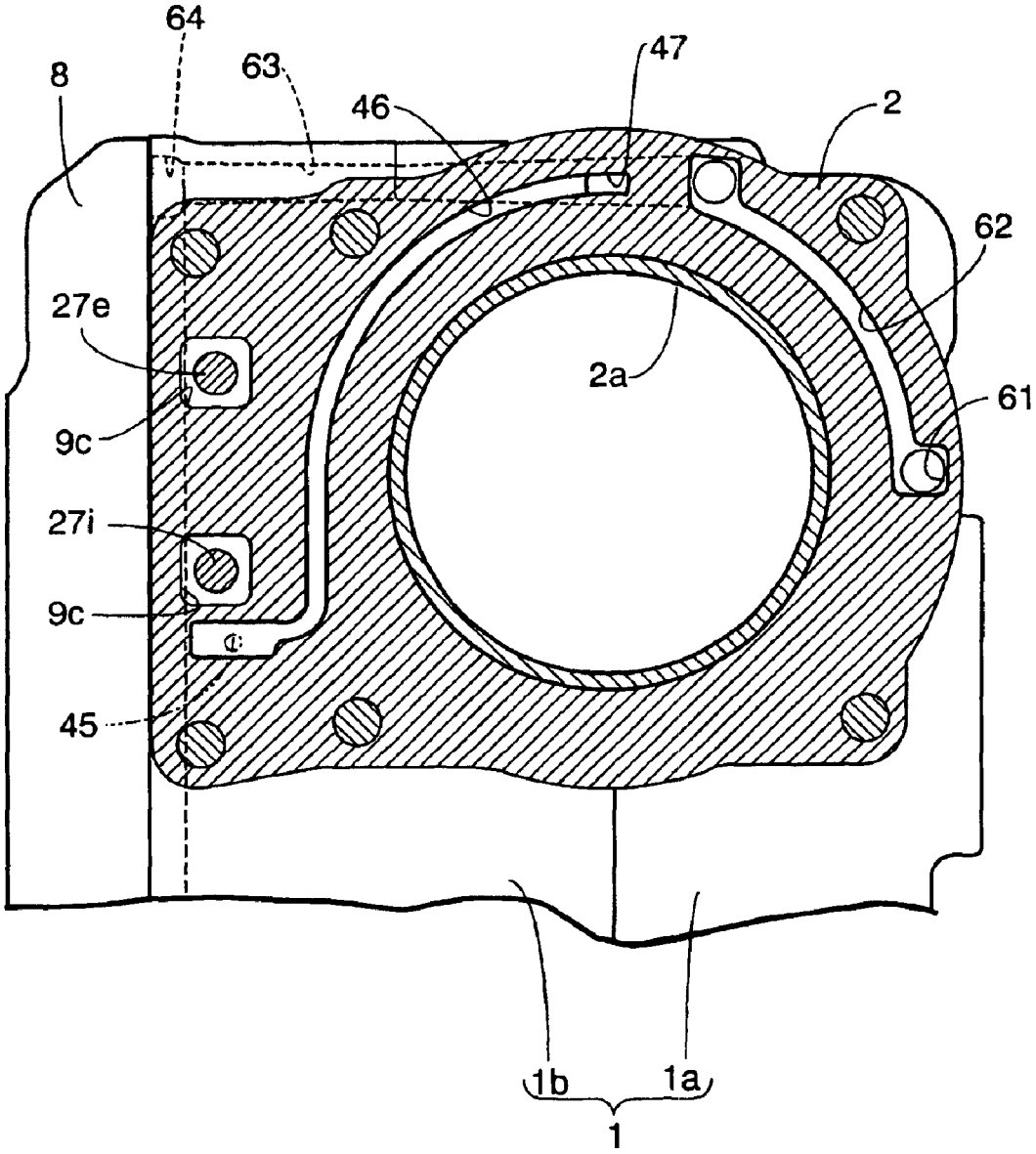
FIG. 10 is a sectional view taken along a line 10—10 in FIG. 9.
Figure 11:
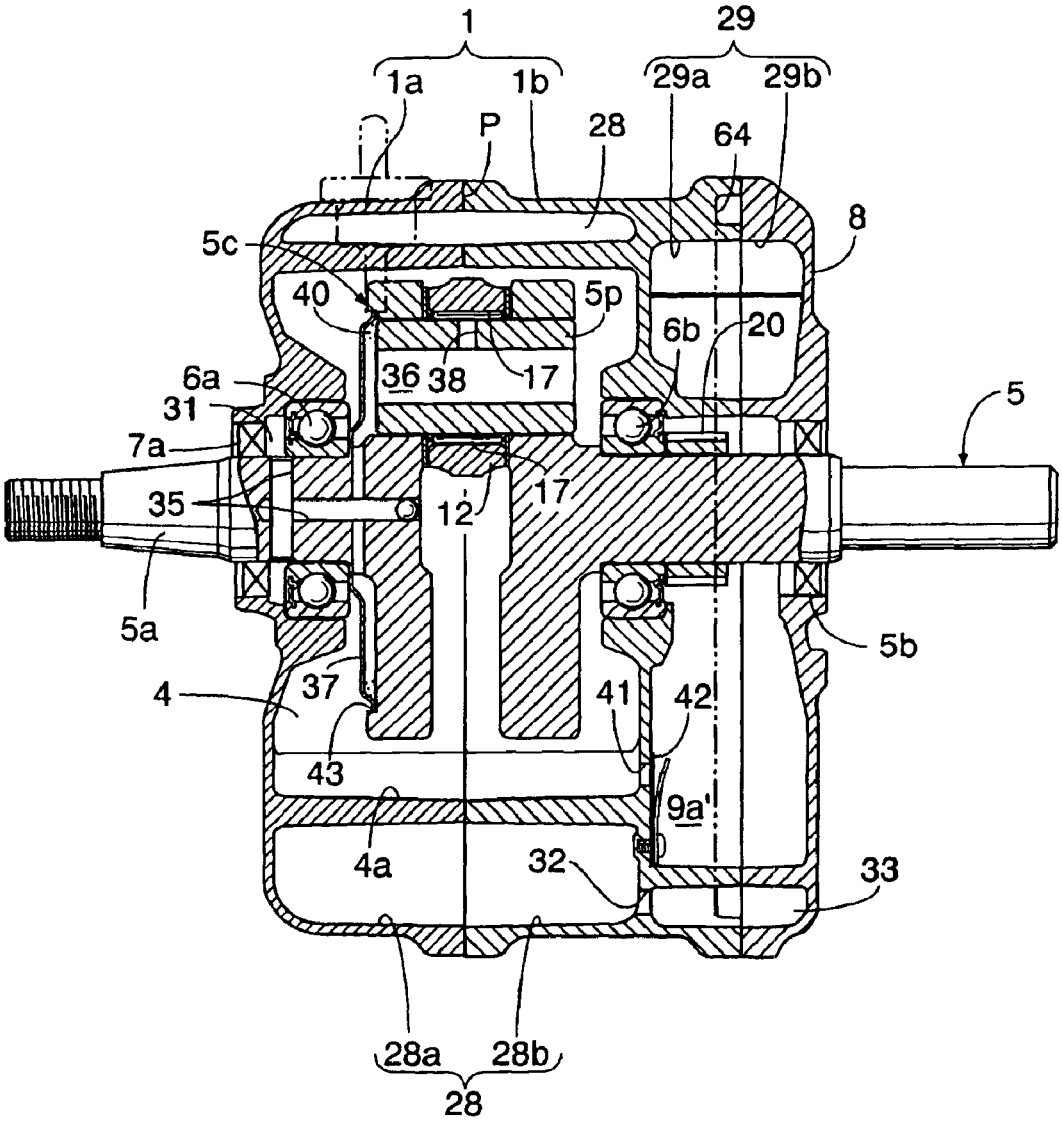
FIG. 11 is a sectional view taken along a line 11—11 in FIG. 8.

Referring to FIGS. 1, 3 and 7, a recovery bore 45 is provided in the cylinder block 2 to open into a lower portion of the second valve-operating chamber 9*b*. A return bore 47 is provided in a region extending from the cylinder block 2 to the crankcase 1. A bent oil passage 46 is formed in the surface of the cylinder block 2 bonded to the crankcase 1, to extend around the cylinder bore 2*a* and connect the recovery bore 45 and the return bore 47 to each other. In this process, the return bore 47 is disposed in the rear of the recovery bore 45 (on an opposite side from the headcover 10) and above the recovery bore 45 and the oil surface of the first oil reservoir chamber 28.

Referring again to FIG. 1, a ceiling wall of the head cover 10 is formed into a double-wall construction comprising an inner wall portion 10*a* and an outer wall portion 10*b* to define a breather chamber 48 at an intermediate portion thereof. A through-bore 49 is provided in the inner wall portion 10*a* to permit the second valve-operating chamber 9*b* and the breather chamber 48 to communicate with each other. A reed valve 50 is mounted in the inner wall portion 10*a* for permitting the flowing of the fluid through the through-bore 49 in one direction from the second valve-operating chamber 9*b* to the breather chamber 48. Further, a small bore 51 is provided in the inner wall portion 10*a* to permit a lower portion of the breather chamber 48 to communicate with the second valve-operating chamber 9*b*.

A breather pipe 52 is connected to the outer wall portion 10*b* to permit the breather chamber 48 to communicate with an air cleaner (not shown) in the intake system of the engine E.

The operation of the first embodiment will be described below.

During operation of the engine E, a pressure in the crank chamber 4 is pulsed by the ascending and descending movements of the piston 11, so that the pulsation of the pressure is applied to the check valve 39 through the hollow 36 in the crankpin 5*p* to open and close the check valve 39. The pulsation of the pressure is also applied to the reed valve 42 through the through-bore 30 to open and close the reed valve 42, and then propagated to the first and second valve-operating chambers 9*a* and 9*b*.

The opening and closing of the check valve 39 ensures that the oil O stored in the first oil reservoir chamber 28 is intermittently drawn into the crank chamber 4 sequentially through the outlet bore 32, the small supply chamber 33, the rising oil passage 34, the annular oil passage 31, the oil bore 35, the delivery dish 37 and the hollow 36 in the crankpin 5*p*, to thereby lubricate the ball bearings 6*a* and 6*b* facing the crank chamber 4. Also, a portion of the oil passed through the hollow 36 in the crankpin 5*p* is passed through the oil supply bore 38 to lubricate the needle bearing 17 interposed between the crankpin 5*p* and the connecting rod 12.

During this process, the oil passed through the inside of the delivery dish 37 rotated along with the crankshaft 5 is rotated in the delivery dish 37, whereby a foreign matter such as chipped powder and abraded powder contained in the oil is separated off by a centrifugal action to be retained in the foreign matter reservoir 40 which is widen radially outwards from the hollow 36 in the crankpin 5*p*. Therefore, the purified oil can be supplied to the crankpin 5*p*, thereby contributing to an enhancement in durability of the engine E.

The oil intermittently drawn into the crank chamber 4 is scattered by a centrifugal force to form an oil mist, when it leaves the rotating crankshaft 5. The oil mist is intermittently pumped from the through-bore 41 to the first valve-operating chamber 9*a* by the opening and closing of the reed valve 42, and passed through the rod passages 55, 55 into the second valve-operating chamber 9*b*, to thereby lubricate various portions of the valve-operating mechanism 19 between the first and second valve-operating chambers 9*a* and 9*b*.

When the oil mist which has finished the lubrication of the valve-operating mechanism 19, for example, is deposited to an inner wall of the second valve-operating chamber 9*b* to be liquefied, this oil is returned from the recovery bore 45 in the lower portion of the second valve-operating chamber 9*b*, through the bent oil passage 46 and the return bore 47, into the first oil reservoir chamber 28 by the pulsation of the pressure in the second valve-operating chamber 9*b*.

The pulsation of the pressure in the second valve-operating chamber 9*b* also opens and closes the reed valve 50 in the breather chamber 48. Therefore, when a blow-by gas generated in the crank chamber 4 rises up to the second valve-operating chamber 9*b* along with the oil mist, the gas is intermittently carried to the breather chamber 48 along with a portion of the oil mist by virtue of the opening and closing, where they are expanded, whereby the gas-liquid separation is conducted. The liquefied oil is returned through the small bore 51 to the second valve-operating chamber 9*b*, and the blow-by gas, from which the oil has been separated, is drawn through the breather pip 52 into the intake system (not shown) and then subjected to a burning treatment.

Thus, it is possible to circulate the oil O stored in the first and second oil reservoir chambers 28 and 29 to various portions of the engine E without use of a special oil pump by utilizing a pumping action provided by the pulsation in the crank chamber 4, leading to a simplification of the lubricating system and in turn to a reduction in cost.

If the oil O in the first oil reservoir chamber 28 is reduced during its circulation through the crank chamber 4, the first valve-operating chamber 9*a*, the rod passages 55, 55, the second valve-operating chamber 9*b*, into the first oil reservoir chamber 28, the oil O in the second oil reservoir 29 is supplied through the through-bore 30 to the first oil reservoir chamber 28. A total volume of the oil reservoir chambers 28 and 29 is large, so that a large amount of oil can be stored in both the chambers, and hence it is possible to enable the operation of the engine E for a long period.

Moreover, the first oil reservoir chamber 28 is formed in the first and second case halves 1*a* and 1*b* constituting the crankcase 1 to surround the crank chamber 4. The second oil reservoir chamber 29 is formed in the second case half 1*b* and the side cover 8 to surround the second valve-operating chamber 9*b*. Therefore, the formation of the first and second oil reservoir chambers 28 and 29 can be achieved only by slightly enlarging the crankcase 1 and the side cover 8 in radial directions, to thereby contribute to the compactness of the engine E.

Especially, the oil drawn from the first oil reservoir chamber 28 into the hollow 36 in the crankshaft 5 is scattered by the rotation of the crankshaft 5 to form the oil mist, and hence an oil slinger for producing an oil mist is not required. Thus, the simplification of the structure can be brought about by a reduction in the number of parts, and also the degree of freedom of shapes of the oil reservoir chambers 28 and 29 is increased because they have no oil slingers, so that the compactness of the entire engine E can be effectively achieved. Moreover, the first oil reservoir chamber 28 is comprised of the recesses 28*a* and 28*b* formed in the bonded surfaces of the first and second case halves 1*a* and 1*b*, respectively, and the second oil reservoir chamber 29 is comprised of the recesses 29*a* and 29*b* formed in the bonded surfaces of the second case half 1*b* and the side cover 8, respectively. Therefore, when the first and second case halves 1*a* and 1*b* and the side cover 8 are formed by casting, they can be formed simultaneously with the formation of the crank chamber 4 and the first valve-operating chamber 9*a*, leading to an easy manufacture and a reduction in cost.

The recovery bore 45 opening into the second valve-operating chamber 9*b* and the return bore 47 opening into the first oil reservoir chamber 28 are isolated from each other in both a horizontal direction and a vertical direction, and communicate with each other through the bent oil passages 46. Therefore, even if the engine is tilted during stoppage of the operation, the oil can be prevented from flowing backwards from the first oil reservoir 28 to the second valve-operating chamber 9*b*, as long as any one of the recovery bore 45 and the return bore 47 is exposed above the oil surface in the first oil reservoir chamber 28.

During the stoppage of the operation of the engine E, the check valve 39 is closed to shut off the oil bore 35 in the crankshaft 5. Therefore, even when the engine E is disposed in a largely inclined state, for example, during installation of the engine E, the oil O in the first oil reservoir chamber 28 can be prevented from disadvantageously flowing into the crank chamber 4, although the oil bore 35 in the crankshaft 5 is disposed below the oil surface in the first oil reservoir 28.

In addition, the delivery of the oil from the oil bore 35 in the second journal portion 5*b* to the oil supply bore 38 in the crankpin 5*p* is conducted by the delivery dish 37 mounted at one end of the crank portion 5*c*. Therefore, it is possible to eliminate the needs for the alignment of the bores during assembling of the crankshaft 5 and the perforation after the assembling, thereby providing a reduction in cost.

A second embodiment of the present invention shown in FIGS. 8 to 11 will now be described.

In the second embodiment, both first and second ball bearings 6*a* and 6*b* supporting first and second journal portions 5*a* and 5*b* of a crankshaft 5 respectively have seals. In contrast to the first embodiment, an annular oil passage 31 is provided in a first case half 1*a* to surround the first journal portion 5*a*, and a delivery dish 37 is mounted to a crank portion 5*c* on the side of the first journal portion 5*a*. A check valve as in the first embodiment for providing communication between the annular oil passage 31 and the delivery dish 37 is not mounted in an oil bore 35 in the crankshaft 5. Instead, the annular oil passage 31 communicates with a small supply chamber 33 leading to a lower portion of the first oil reservoir chamber 28 through the following oil passages: an oil passage 61 extending forwards from a front portion of the annular oil passage 31 in parallel to the axis of the cylinder bore 2*a* through the sidewall of the first case half 1*a*; an oil passage 62 passing through the bonded surfaces between the crankcase 1 and the cylinder block 2 to extend upwards from a front end of the oil passage 61 along an inner peripheral wall of the cylinder bore 1*a*; an oil passage 63 passing through an upper wall of the crankcase 1 from an upper end of the oil passage 62 to the side cover 8; and an oil passage 64 passing through between the bonded surfaces of the second case half 1*b* and the side cover 8 to bypass downwards the second oil reservoir 9*b*.

Thus, the oil passages 61 to 64 communicating with the annular oil passage 31 surrounding the first journal portion 5*a* of the crankshaft 5, once extend above the oil surfaces in the first and second oil reservoir chambers 28 and 29, and are then bent downwards to reach the small supply chamber 33 leading to the lower portion of the first oil reservoir chamber 28. Therefore, when the engine E is disposed in a largely inclined state during stoppage of its operation, the oil can be prevented from disadvantageously flowing from the first oil reservoir chamber 28 through the annular oil passage 31 into the crank chamber 4, even if a check valve 39 is not mounted in the crankshaft 5 as in the first embodiment.

The structure of the other components is the same as that in the first embodiment, and hence portions or components corresponding to those in the first embodiment are designated by the same reference numerals and symbols and the description of them is omitted.

The present invention is not limited to the above-described embodiments, and various modifications in design may be made without departing from the spirit and scope of the invention defined in the claims.

What is claimed is:

1. A lubricating system for a 4-cycle engine in which a side cover defining a first valve-operating chamber is bonded to one side of a crankcase defining a crank chamber which accommodates a crank portion of a crankshaft; a head cover defining a second valve-operating chamber leading to the first valve-operating chamber is bonded to a head portion of a cylinder block connected to the crankcase; and a valve-operating mechanism is accommodated in a region extending from the first valve-operating chamber to the second valve-operating chamber, wherein oil reservoir chambers for storing lubricating oil up to a level higher than a journal portion of the crankshaft are defined by recesses formed in the crankcase and the side cover to surround the crank chamber and the first valve-operating chamber; oil supply passages are provided in the crankshaft to permit a portion of each of the oil reservoir chambers below an oil surface therein to communicate with the crank chamber so that the oil passed through the oil supply passages can be scattered to produce an oil mist the crank chamber is put into communication with the first valve-operating chamber through a one-way valve which is adapted to be opened only when the pressure in the crank chamber is raised; a recovery bore which opens into a bottom of the first valve-operating chamber or the second valve-operating chamber for recovering liquefied oil is put into communication with a portion of each of the oil reservoir chambers above the oil surface; and a breather chamber is put into communication with an upper portion of the second valve-operating chamber.

2. A lubricating system for a 4-cycle engine according to claim 1, wherein a check valve adapted to be opened upon a reduction in pressure in the crank chamber is incorporated in at least one of the oil supply passages.

3. A lubricating system for a 4-cycle engine according to claim 1, wherein the oil supply passages in the crankshaft are put into communication with a portion of each of the oil reservoir chambers below the oil surface through a bent communication passage having an intermediate portion disposed in a bent shape above the oil surface of each of the oil reservoir chambers.

4. A lubricating system for a 4-cycle engine according to claim 1, wherein said oil reservoir chambers comprise a first oil reservoir chamber formed in the crankcase to surround the crank chamber, and a second oil reservoir chamber formed between the crankcase and the side cover bonded to one side of the crankcase to define the valve-operating chamber which accommodates the valve-operating mechanism; the first and second oil reservoir chambers being in communication with each other.

5. A lubricating system for a 4-cycle engine according to claim 4, wherein the crankcase is comprised of first and second case halves bonded at their bonded surfaces perpendicular to an axis of the crankshaft; said recessed defining said first oil reservoir chamber are formed in the bonded surfaces of the first and second case halves to surround the crank chamber; said recesses defining said second oil reservoir chamber are formed in bonded surfaces of the second case half and the side cover bonded to an outer side of the second case half to surround the valve-operating chamber; and a through-bore permitting the communication between said first and second oil reservoir chambers is provided in the second case half.

6. A lubricating system for a 4-cycle engine according to claim 1, wherein the oil mist is produced by centrifugal force when the scattered oil leaves the rotating crankshaft.

* * * * *